United States Patent [19]

McAnelly

[11] Patent Number: 4,586,703

[45] Date of Patent: May 6, 1986

[54] METHOD AND APPARATUS FOR HIGH-SPEED MOUNTING OF DOCUMENTS ON ZIG-ZAG CARRIER

[75] Inventor: Jan A. McAnelly, West Linn, Oreg.

[73] Assignee: Block Business Forms, Inc., Portland, Oreg.

[21] Appl. No.: 634,797

[22] Filed: Jul. 26, 1984

[51] Int. Cl.[4] ..... B41L 1/32

[52] U.S. Cl. ..... 270/39; 493/423

[58] Field of Search ..... 270/39–40, 270/52, 58, 52.5, 57, 11, 44; 229/69; 53/545–546, 266 R, 266 A; 493/126–128, 163, 177–179, 399, 231, 345, 356–358, 380, 405, 410, 416–417, 422–424, 441, 448, 454, 430; 400/613.2, 622; 206/499; 156/299, 303, 548, 552, 556

[56] References Cited

U.S. PATENT DOCUMENTS

| | | | |
|---|---|---|---|
| 568,307 | 9/1896 | Meisel | 493/422 |
| 1,290,800 | 1/1919 | Teall | 270/39 |
| 1,347,242 | 7/1920 | Bartlett | 270/39 |
| 1,415,220 | 5/1922 | Causebrook | 270/40 X |
| 3,214,083 | 10/1965 | Jory | 270/52 |
| 3,406,959 | 10/1968 | Ross | 493/359 |
| 3,484,097 | 12/1969 | Jory | 270/52 |
| 3,572,682 | 3/1971 | Leach | 270/52 |
| 3,937,452 | 2/1976 | Gath | 270/53 |
| 3,947,013 | 3/1976 | Nystrand | 493/441 X |
| 4,034,210 | 7/1977 | Hill et al. | 53/266 A |
| 4,063,398 | 12/1977 | Huffman | 493/216 X |
| 4,373,986 | 2/1983 | Cone | 270/58 |
| 4,514,182 | 4/1985 | Vermehren | 493/380 |

FOREIGN PATENT DOCUMENTS

| | | | |
|---|---|---|---|
| 637069 | 4/1928 | France | 270/57 |
| 1408247 | 7/1965 | France | 270/39 |
| 602352 | 7/1978 | Switzerland | 270/39 |

*Primary Examiner*—E. H. Eickholt

*Attorney, Agent, or Firm*—Chernoff, Vilhauer, McClung, Birdwell & Stenzel

[57] ABSTRACT

An apparatus for assembling carrier-mounted documents includes a glue station, a folding station and a document feeding station. Adhesive is selectively applied to an elongate sheet of carrier paper having a plurality of transverse perforations. The carrier paper is fed into a moving paddle belt, the paddles striking the carrier paper proximate selected perforations and causing the carrier paper to fold thereon. The paddle belt moves the partially folded carrier paper past a high-speed document feeder where documents are inserted into the folds in the carrier paper and retained there by the previously applied adhesive. The folds in the carrier paper position and align the documents on the carrier paper as they are received from the document feeder. Pin holes along the elongate margins of the carrier paper cooperate with pin chains and pin rollers on the apparatus to time and position the pre-perforated carrier paper with respect to the apparatus.

15 Claims, 9 Drawing Figures

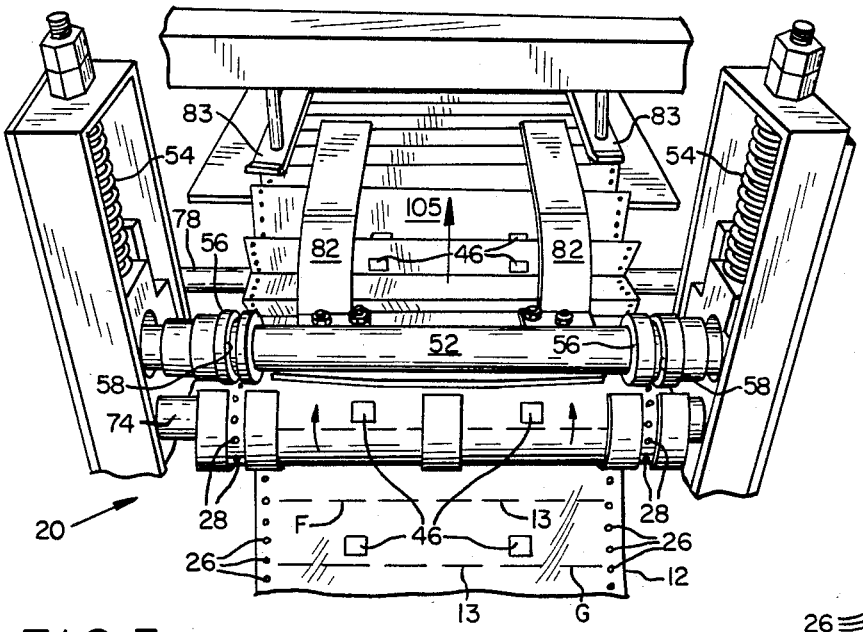
FIG. 3
FIG. 8
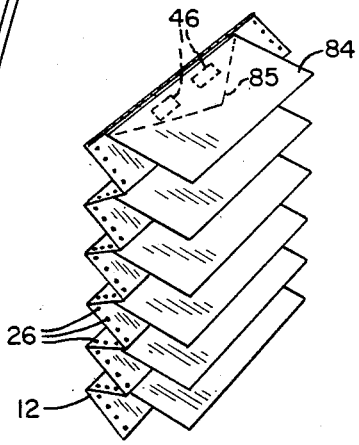
FIG. 4
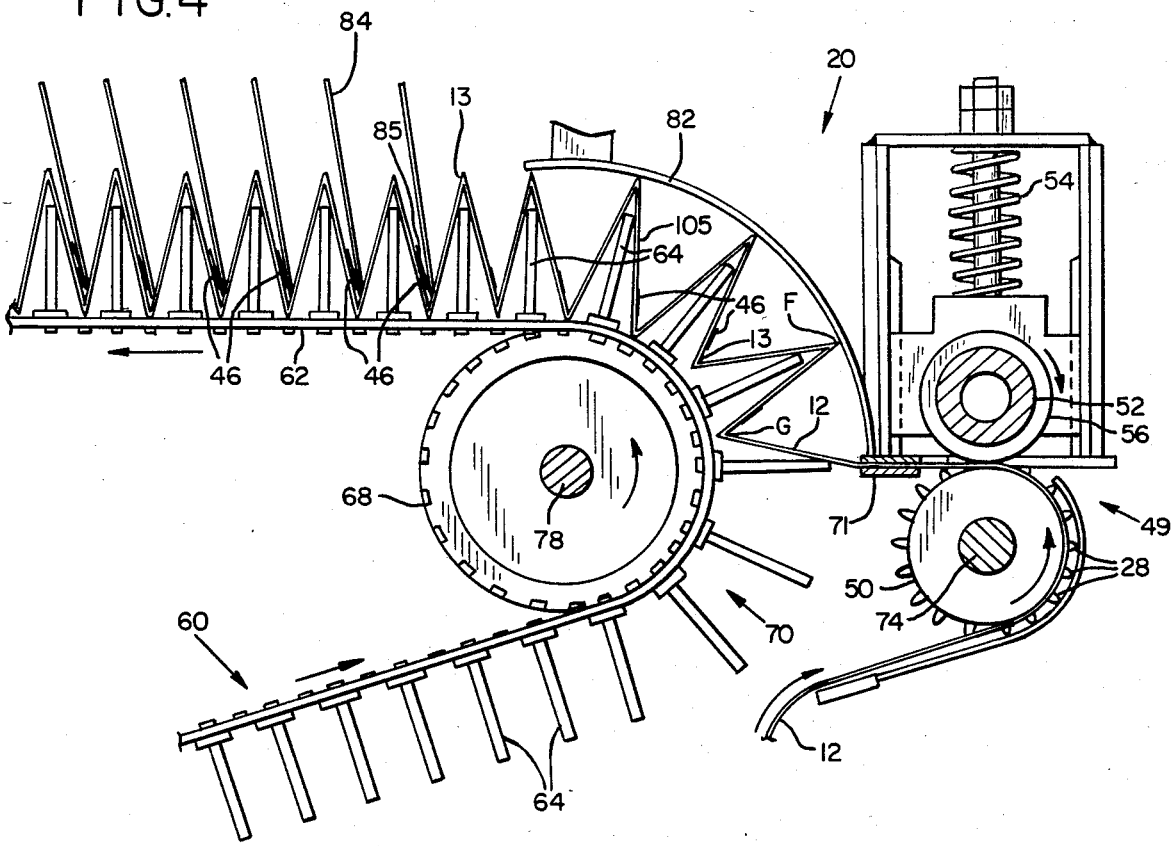

METHOD AND APPARATUS FOR HIGH-SPEED MOUNTING OF DOCUMENTS ON ZIG-ZAG CARRIER

BACKGROUND OF THE INVENTION

This invention relates to a method and apparatus for mounting documents on an elongate sheet of carrier paper and more particularly to such a method and apparatus which first folds the carrier paper and employs the folds to precisely register the documents on the paper.

The technique of employing a web of carrier-mounted documents such as envelopes, letterhead, business forms or the like, in combination with a high-speed printer to quickly and economically perform essentially repetitive printing tasks such as addressing envelopes for a mass mailing is widely recognized. The printer is typically controlled by a computer which times the printer to the advancement of the carrier paper through the printer. Accordingly, proper and regular alignment of the documents on the carrier paper is essential for such purposes.

Prior art methods of attaching such documents to the carrier sheet in proper registry generally tip the document, such as an envelope or letterhead, flat onto the carrier sheet where it is held in place by adhesive. Prior art "tip-on" devices of this type include the Communicator, distributed by Forms Manufacturing Equipment, Inc., of Orlando, Florida, and the Hunkeler, manufactured by Joseph Hunkeler, Ltd., Wikon, Switzerland. Since these machines place the document flat onto a flat carrier sheet, they must employ relatively expensive and complicated mechanisms to ensure that the documents are properly aligned or registered on the carrier sheet, with respect to the carrier sheet and with respect to each other. Proper registry is typically accomplished either by causing the document to move at the same speed as the carrier sheet as the document is placed onto the continuously moving carrier sheet or intermittently stopping the carrier sheet to place a document thereon, then advancing the carrier sheet and stopping it again to place another document. As a consequence, both types of machines are limited in the rate at which they can assemble documents onto the carrier sheet. After the documents have been attached to the carrier sheet, the carrier sheet with the documents mounted thereon typically must be folded into a web suitable for use in a printer.

Applicant is also aware of two contemporaneous tip-on devices which may not be prior art with respect to the present invention, the TT Envelope Attaching Machine manufactured by Nale, Inc., of Woodstock, Georgia, and a device used by Jonergin of Fort Lee, New Jersey. Both of these devices also apply the document to a flat carrier sheet, the Nale device appearing to employ the intermittent method of registry while the Jonergin device appears to match the document speed to the speed of a continuously moving carrier sheet. Consequently, these latter devices are similarly limited in the rate at which they can assemble documents onto the carrier sheet.

SUMMARY OF THE INVENTION

The present invention overcomes many of the disadvantages of the prior art by providing a method and apparatus for folding carrier paper and employing the folds to guide and position the documents onto the carrier paper in precise registry. As a consequence, the apparatus of the present invention does not require complicated registry systems and may be constructed relatively inexpensively. More importantly, however, the apparatus of the present invention is capable of assembling documents on carrier paper dramatically faster than any of the prior art devices.

The method and apparatus of the present invention applies a fast-drying glue to pre-selected locations on an elongate sheet of pre-perforated carrier paper. The carrier paper is then fed into a moving array of spaced-apart paddles which strike the carrier sheet proximate selected perforations, causing the carrier sheet to fold thereon. The paddle assembly moves the partially folded carrier sheet past a high-speed document feeder while maintaining it in an open wave-form configuration. The document feeder inserts documents, such as letterhead or envelopes, into the troughs of the partially folded carrier sheet and the documents are aligned on the carrier sheet in proper registry by the folds formed in the carrier sheet. So positioned, the documents are retained in place by the previously applied glue, and the partially folded carrier sheet, with documents attached thereto, is compressed into a fully folded configuration.

Accordingly, it is a primary objective of the present invention to provide an improved method and apparatus for mounting documents onto carrier paper.

It is an associated object of the present invention to provide such an apparatus which folds the carrier paper.

It is a further object of the present invention to provide such an apparatus which uses the folds in the carrier paper to guide and position the documents onto the carrier paper in proper registry.

It is a further object of the present invention to provide such an apparatus which is capable of high speed assembly of carrier-mounted documents.

It is a further object of the present invention to provide carrier mounted documents which have been positioned on the carrier paper in proper registry by folds in the carrier paper.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 3 is a perspective view of the folding station of the present invention.

FIG. 4 is a side elevational cross-sectional view of the folding station of FIG. 3.

FIG. 8 is a perspective view of carrier-mounted envelopes.

DETAILED DESCRIPTION OF THE INVENTION

Figure 1:
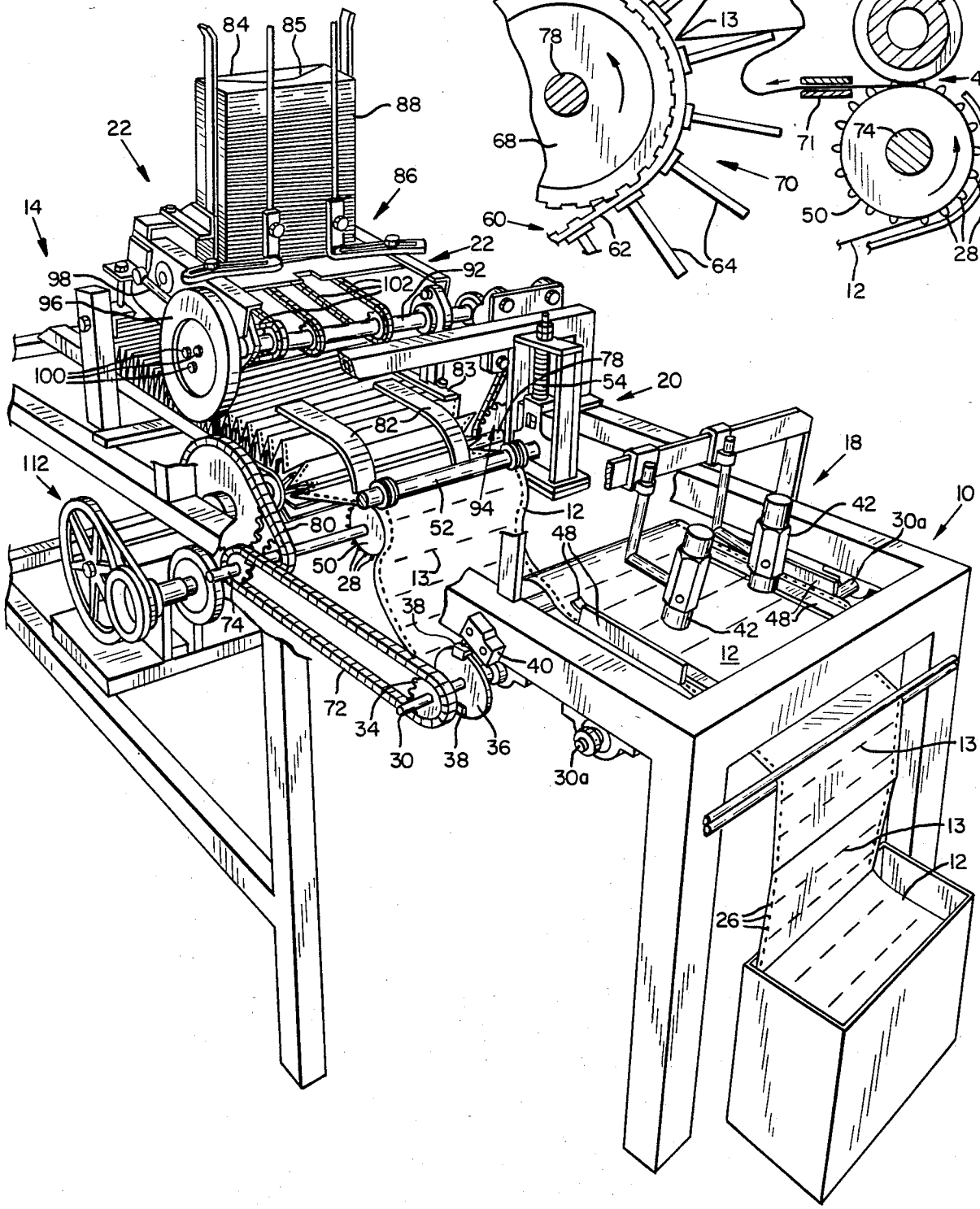
FIG. 1 is a partially cut-away perspective view of the exemplary embodiment of the present invention from the feed end of the aparatus.
Figure 2:
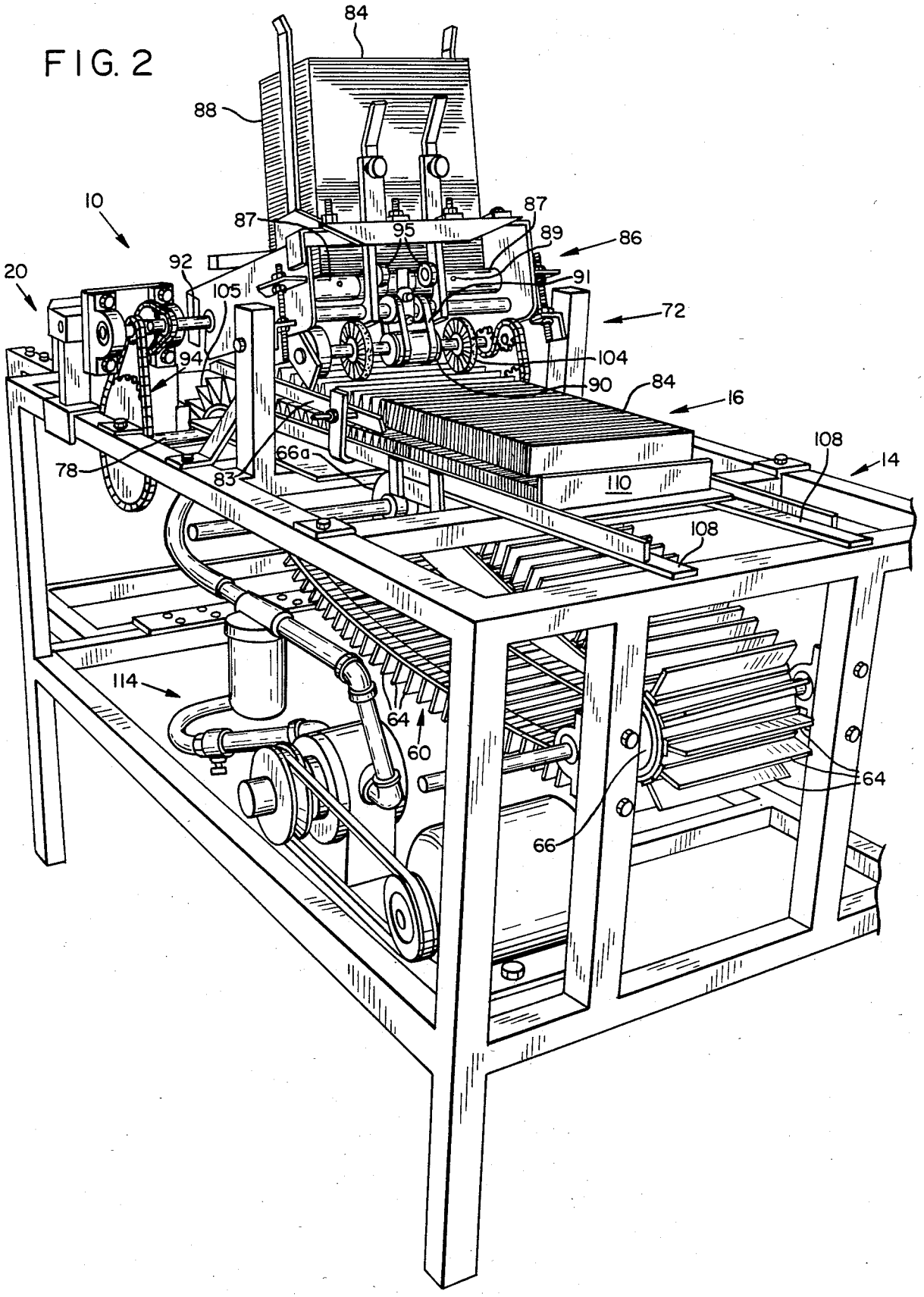
FIG. 2 is a perspective view of the exemplary embodiment of the present invention from the delivery end of the apparatus.

Referring an exemplary embodiment of the invention shown in FIGS. 1 and 2, the apparatus of the present invention has a feed end 10 for receiving preperforated carrier paper 12 and a delivery end 14 where a web 16 of folded carrier paper and carrier-mounted documents such as envelopes 84 are delivered. As the carrier paper moves through the apparatus it passes a glue station 18 which applies adhesive to selected areas of the carrier paper, a folding station 20 which folds the carrier paper into an open wave-form configuration, and a document feeding station 22 which selectively feeds documents, such as envelopes into the folds of the carrier paper. The components and the operation of the exemplary embodiment of the apparatus shown in FIGS. 1 and 2, as well as the methods of the present invention, are explained primarily with reference to the schematic and fragmentary drawings of FIGS. 3 through 9.

Figures 5, 6, 7:
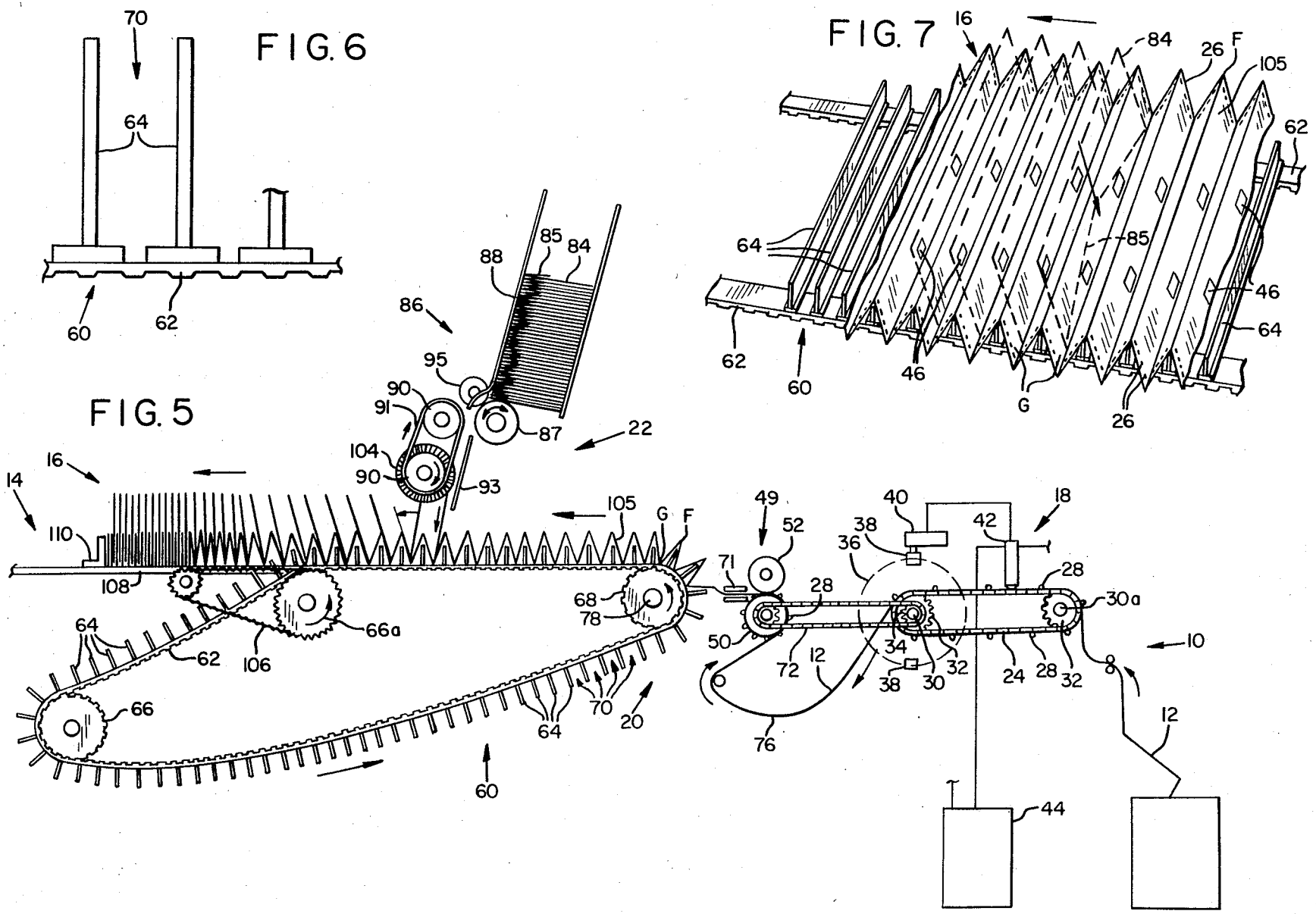
FIG. 5 is a schematic, side elevational view of the present invention.
FIG. 6 is a fragmentary side elevational view of the paddle belt of the present invention.
FIG. 7 is a fragmentary perspective view of the paddle belt of the present invention having folded carrier paper arranged thereon.

Referring initially to FIG. 5, an elongate sheet of pre-perforated carrier paper 12 having a plurality of parallel perforations 13, which may be seen in FIGS. 1 and 3 extending across the carrier paper perpendicular to the length thereof, is fed into the apparatus by a pair of parallel-oriented pin drive chains 24 having spaced pins 28 mounted thereto for engaging selected ones of the pin holes 26 arranged along the length-wise margins of the carrier paper. A pair of pin drive shafts 30 and 30*a*, each mount a pair of gears 32 on the opposite ends thereof for rotatably supporting the two pin drive chains in parallel orientation. A pin drive gear 34 fixed on pin drive shaft 30, drives both pin drive chains in unison to feed the carrier paper through the glue station 18. As will be explained below, the pins also provide an important indexing function to index the perforations of the carrier paper to the apparatus.

A cam wheel 36 having a pair of movable cams 38 mounted on the circumference of the cam wheel is also fixed on the pin drive shaft 30 so as to rotate synchronously with the pin drive chains 24. The cams on the rotating cam wheel activate a switch 40 mounted to the supporting structure of the apparatus to electrically trigger a pair of glue heads 42, positioned above the carrier paper, to spray a fine mist of adhesive onto the carrier sheet to create a pair of adhesive patches 46 on the carrier paper. Although the apparatus shown in FIG. 5 employs a pressurized glue pot 44 communicating with the glue heads, alternative methods of applying adhesives such as by contact sponge applicators or the like are contemplated.

The cams 38 are releasably fixed to the cam wheel 36 and may be moved to other positions on the circumference of the cam wheel, or additional cams may be added, or cams may be removed, from the cam wheel to change where and how frequently adhesive is applied to the carrier paper. Since the cam wheel and pin drive chains are driven by a common shaft, the cams may be arranged on the cam wheel in a desired relationship certain of the pins 28 on the pin drive chain 24. The pins, in turn, may be referenced to selected perforations on the pre-perforated carrier paper by engaging 15 pinholes 26 which are proximate the selected perforations, thus allowing the glue to be selectively and precisely applied with reference to selected perforations.

For example, in the exemplary embodiment shown in the drawings, the carrier paper shown in FIG. 7 has a pair of adhesive patches 46 immediately preceeding every other perforation henceforth referred to as a glue perforations G. Once the pin holes 26 of the carrier paper have been engaged by the pins 28 on the pin drive chain 24, the relationship of the glue perforations to a reference pin on the pin drive chain and consequently to the cam wheel 36 is established. The cams 38 may then be moved to a desired position on the circumference of the cam wheel 36 to trigger the glue heads 42 to spray an adhesive patch immediately preceeding the glue perforations G. Alternatively, the relationship between the cams and a reference pin may be pre-established and the paper may be engaged on the pin drive chains with the glue perforations in a desired relationship to the reference pin and therefore in a desired relationship to the cams on the cam wheel.

Paper guides 48 which may be seen in FIG. 1, guide the paper 12 through the glue station and press down upon the paper near the pin holes 26 to ensure that the paper remains in engagement with the pins 28 of the pin drive chain 24.

The paper 12, with adhesive patches 46 applied thereto immediately preceeding every glue perforation G, proceeds from the glue station 18 to the folding station 20 as shown in FIGS. 1, 3, 4 and 5. The folding station includes a paper feeder 49 having a pin roller 50 fixed to a pin roller shaft 74, the pin roller also having pins 28 mounted thereon for engaging the pin holes in the carrier paper. A press roller 52 is rotatably mounted above and parallel to the pin roller for rotation therewith and cooperates with the pin roller to move the paper through the paper feeder. Biasing springs 52 force the press roller down upon the pin roller with sufficient force to cause the press roller and pin roller to rotate in unison. A pair of rubber collars 56 having grooves 58 formed therein are mounted on the press roller in such a fashion that the pins of the pin rollers fit into the grooves of the collars as the two rollers rotate in unison as shown in FIG. 3.

As shown in FIGS. 4 and 5, the pin roller and press roller cooperate to feed the carrier paper, in a direction substantially normal to the perforations 13, into a moving paddle belt assembly 60 to fold the paper. The paddle belt assembly includes a pair of endless flexible gear belts 62 which cooperatively mount an array of parallel spaced-apart paddles 64 extending perpendicular to the length of the belts, the belt and paddles defining parallel channels 70 between adjacent paddles. Several pairs of idler gears 66, 66*a* and a pair of drive gears 68, respectively support and drive the paddle belt assembly continuously past the paper feeder in a direction substantially normal to the paddles.

The paper feeder 49 includes a pair of lips 71 to guide the paper from the paper feeder toward the paddle belt assembly 60, the lips defining the plane of the paper as it exits from the paper feeder. The drive gears 68 for the paddle belt assembly 60 are mounted on the main drive shaft 78 of the apparatus. The main drive shaft is aligned parallel to the pin roller shaft 74 and is contained within or closely parallel to the plane of the paper as it emerges from the lip of the paper feeder. Accordingly, when the paddle belt assembly is driven by the drive gears 68 attached to the main drive shaft, each paddle successively passes through the aforementioned paper plane defined by the lips and is briefly co-planar with the paper as it passes the lips of the paper feeder. The paddle belt assembly is positioned with respect to the paper feeder so that simultaneous operation of the paddle belt assembly and the paper feeder causes the paper to enter the channels 70 between adjacent paddles and be struck by the paddles as they pass the paper feeder.

Figure 9:
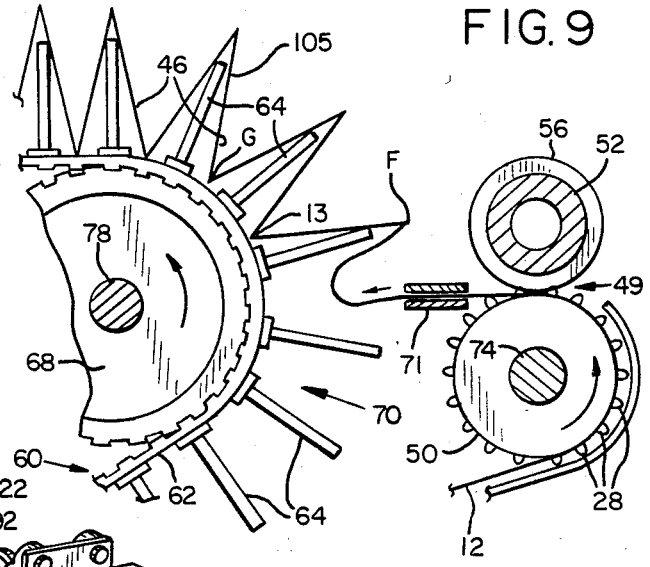
FIG. 9 is a schematic, side elevational view of the folding station of FIG. 3.

Referring to FIGS. 4 and 9, as each paddle 64 of the paddle assembly 60 passes the paper feeder 49, the edge of the paddle strikes the carrier paper proximate to and parallel to a selected perforation, henceforth referred to as a fold perforation F, causing the carrier paper to fold on the fold perforation. As the paddle passes up and out of the plane of the paper, the paper feeder continues to feed paper into the channel 70 below the paddle as shown in FIG. 9 until the next paddle passes into the plane of the paper, striking the paper proximate a fold perforation F, causing the paper to fold thereon and also causing the paper to fold or bend upon another perforation intermediate the fold perforations F. In the exemplary embodiment glue perforations G and fold perforations F alternate on the carrier paper so that the paper is caused to fold on a glue perforation G in direction opposite the direction the paper is folded on a fold perforation F.

As can be seen in FIGS. 4 and 5, the moving paddle assembly 60 carries the partially folded web 16 of carrier paper away from the folding station 20, supporting the carrier paper in an open-wave form configuration with peaks coinciding with fold performations F, and troughs coinciding with glue perforations G, the folds defining a plurality of faces therebetween. The paddle assembly supports the folded web in such a fashion that the troughs are received by the channels 70 between the paddles. A pair of curved guards 82 overlap with a pair of straight side guards 83 as seen in FIGS. 1 and 3 to maintain the carrier paper in folded configuration and in contact with the paddle assembly. Without such guards 82 and 83, the partially folded carrier paper would have a tendency to straighten and lift partially out of the channels 70 between the paddles.

It will be apparent that the paddle assembly 60 must be indexed to the carrier paper 12 in some fashion in order for the paddles 64 to consistently strike the paper on the fold perforations F. As previously mentioned, the pins 28 associated with the pin drive chain 24 of the glue station 18 serve to index the gluing operations to the glue perforations G. In a similar manner, the pins 28 on the pin roller 50 index the fold perforations F on the carrier paper to the paper feeder 49 and consequently to the paddle assembly 60.

As can be seen in FIGS. 1 and 5, a transfer chain 72 interconnects the pin roller shaft 74 and the pin drive shaft 30 so that the carrier paper passes through the glue station 18 and the paper feeder 49 at the same rate. A reference pin on the pin roller corresponds to a reference pin on the pin drive chain so that the glue perforations G, fold perforations F, and adhesive patches 46 on the carrier paper can be referenced to the paper feeder 49 in the same fashion that they were referenced to the glue station. As shown in FIG. 5, a belly 76 is allowed to form in the paper between the glue station 18 and the paper feeder 49 to ensure that slight differences in the rate at which the paper is passed from the glue station to the paper feeder does not break or tear the sheet of carrier paper. As explained above, the pins 28 on the pin roller 50 allow the paper to be reindexed to the apparatus.

Referring to FIGS. 4 and 6, the paddles 64 are mounted on a gear belt 62 which is trained over drive gears 68 fixed to a main drive shaft 78. The mating teeth of the gear belt 62 and drive gear 68 index the position of the paddles to the rotation of the main drive shaft. A timing chain 80 shown in FIG. 1 establishes a fixed relationship between the rotation of the main drive shaft and the rotation of the pin roller shaft. Such linkage ensures that once the paddle assembly and paper feeder are arranged so that a paddle strikes the paper proximate a fold perforation F, the respective gears, belts, shafts and chains will maintain the paper feeder in registry with the paddle belt assembly so that simultaneous operation of the paddle assembly and the paper feed will cause the paddles to continually strike the paper proximate the fold perforations F.

Turning now to FIGS. 1 and 5, the paddle belt assembly 60 carries the partially folded carrier paper from the folding station 20 past the document feeding station 22 where envelopes 84, in the case of the exemplary embodiment, are inserted into the troughs, the envelopes coming to rest on the fold along the glue perforation G at the bottom of the trough and being positioned longitudinally on the carrier paper by such fold. A high-speed document feeder 86 such as a Halm Jet, manufactured by Halm Instruments Co., Inc., of Glenhead, New York and disclosed in U.S. Pat. Nos. 3,796,426, 3,497,205 and 3,423,084 is employed to feed the envelopes into the troughs. The Halm Jet employs a reciprocating vacuum drum 87 which may be seen in FIGS. 2 and 5 to successively remove envelopes 84 from the stack 88 and place the envelopes into contact with an arrangement of draw rolls which forcefully thrust the envelope down into the troughs formed in the carrier paper where it rests upon and is positioned by the fold. Vacuum pressure operating through vacuum holes 89 in the surface of the vacuum drum 87 permits the vacuum drum to grip the bottom envelope in the stack. The vacuum drum then makes a partial revolution, thrusting the envelope into contact with a pair of upper draw rolls 95, shown in FIGS. 2 and 6, which cooperate with a pair of opposing draw rollers, integrated into the vacuum drum assembly, to thrust the envelopes down into contact with belts 91 which are trained over an arrangement of lower draw rolls 90. A chute 93 guides the envelopes down toward the moving paddle belt and maintains the envelopes in contact with the belts 91 of the lower draw rolls 90. Positioning the document feeder above the paddle belt assembly allows the cooperation of gravitational forces to pull the envelope down to the fold at the bottom of the trough. A vacuum source 114 for the vacuum drum can be seen in FIG. 2.

As with the other elements of the apparatus, it is esssential that the document feeder operate in registry with the paddle belt assembly 60 so that an envelope is inserted into each trough. To accomplish this, the main drive shaft 78 is connected to the document feed drive shaft 92 by a gear reduction system 94 which can be seen in FIGS. 1 and 2. An adjustable cam wheel 96 is mounted on the document feed drive shaft for rotation therewith and is operably connected to an arm 98 which operates the reciprocating vacuum drum. Adjustment bolts 100 allow the adjustable cam wheel to be adjusted to cause an envelope to be inserted into each trough. Of course, the cam wheel could be adjusted to cause envelopes or other documents to be inserted only into selected troughs, such as every third trough, rather than every trough. As shown in FIG. 1, the document feed drive shaft 92 also drives the upper and lower draw rolls 90 and 95 through drive chains 102.

A pair of rotatable circular brushes 104 mounted co-axially with the lowermost pair of lower draw rolls 90 brush the envelopes forward into contact with the adhesive patches 46 located on the leading face 105 of the folded carrier paper.

As shown in FIG. 5, a pair of transfer belts 106 supports the web 16 of carrier-mounted envelopes near the delivery end 14 of the apparatus and allows the gear belt 62 to fall away. The transfer belt is driven by the gear belt 62 passing over the upper idler gear 66*a*. The transfer belt transfers the web 16 onto a pair of edge trays 108 which support the web along each side thereof as can be seen in FIG. 2. A stop 110 extending between the edge trays causes the web to compress as the transfer belt continues to deliver more carrier-mounted envelopes to the edge trays 108. This compression and consolidation of the web 16 of carrier-mounted envelopes is desirable to ensure that the folds are formed crisply in the carrier paper along the perforations and also serves to urge the envelopes into close contact with the adhesive patches 46. Other alternatives such as an off-loading belt which travels slower than the gear belt would also serve to off-load and compress the web.

A single motor 112 drives the main drive shaft 78 through an arrangement of belts and pulleys. All of the other drives in the apparatus are either directly or indirectly driven by the main drive shaft so that increasing the rotational speed of the main drive shaft increases all the other drives in appropriate proportion to maintain the timing of the apparatus. With reference to FIG. 1, the main drive shaft 78 drives the pin roller shaft 74 through the timing chain 80. The pin roller shaft 74 causes the pin roller 50 and press roller 52 to rotate and also drives the pin drive shaft 30 through the transfer chain 72. As previously mentioned, the document feeder, draw rolls and brushes are all driven by the document feeder drive shaft 92 which is also driven by the main drive shaft 78 through the gear reduction system 94.

The web 16 of carrier-mounted envelopes 84 may be seen in FIGS. 4, 7 and 8. As previously explained, the envelopes 84 are inserted into the troughs of the folded carrier paper so that a margin of the envelope rests upon and substantially coincides with the fold at the bottom of the trough along the glue perforation G. Thus the envelopes are positioned longitudinally on the carrier sheet 12 in fixed parallel relation to each other by the parallel folds at the bottom of the troughs. The envelopes are uniformly positioned on the width of the carrier paper by the relative position of the document feeder 86 to the width of the carrier sheet. A pair of adhesive patches 46 have been applied to the leading faces 105 of the carrier sheet preceeding the glue perforations G. The envelopes 84 are placed in the stack 88 with the flap 85 facing up and toward the delivery end 14 of the apparatus as shown in FIG. 5. Accordingly, the envelopes are thrust down into the troughs so that the flap 85 of the envelope is adjacent to the face 105 of the folded carrier paper having the adhesive patches 46. The brushes 104 and the aforementioned compression step press the flaps of the envelopes against the adhesive patches thereby releasably fixing the envelopes to the web in the position they have been guided to by the folds.

Referring to FIG. 8, a web 16 of carrier-mounted envelopes 84 is shown in partially folded configuration with the envelopes face up. From FIG. 8 it can be seen that as the web is passed through a printer, a portion of the face of each envelope will be presented to the printer for printing thereon, and that the envelopes will overlap slightly, the upper envelope over the lower envelope. The slight overlap serves two purposes, first it allows more envelopes to be mounted on a given length of carrier sheet, and secondly, the overlap does not provide an edge which could catch on the machinery of the printer and tear the envelope off the carrier sheet or jam the printer. Of course, if it is desirable to avoid the overlap, this may be easily done by increasing the length of the face between the folds, or even inserting an envelope into every other fold.

Since the adhesive is applied to the carrier sheet near the feed end 10 prior to the folding and document feeding operation, care must be taken to prevent the adhesive patches 46 from contacting or fouling other portions of the apparatus. This may be accomplished by notching the lips 71 that feed the paper into the paddle assembly 60 and appropriate positioning of the various guides which guide the paper through the apparatus as shown in FIG. 3. Of course, it is not necessary to the present invention that the adhesive be applied prior to folding, or even that adhesive be applied to the carrier sheet. For example, adhesive may be applied to the documents rather than the carrier sheet, and, in fact, the Halm Instrument Co., Inc. has patented a device for feeding documents having adhesive applied thereon; Schilpf, U.S. Pat. No. 3,796,426.

It should be apparent that the present method and apparatus are not confined to mounting envelopes to carrier paper. Suitable adjustments in the dimension of the fold, the configuration of the document feeder and other adjustments would allow credit cards, letterhead, business forms or the like to be mounted on the carrier paper. Referring again to FIGS. 4 and 9, it can be understood that by varying the spacings of the perforations 13 in the carrier paper, the feed speed of the paper feeder 49 or the height of the paddles 64 as they extend from the belt would enable an apparatus substantially similar to the exemplary embodiment to make folds of different sizes in the carrier sheet. Indeed, by operating a pair of document feeders alternatively, one feeding envelopes and one feeding letterhead, an envelope/letterhead set may be mounted on the carrier sheet.

Although the exemplary embodiment shown in the drawings and described above employs pre-perforated carrier paper having a plurality of perforations extending across the carrier sheet perpendicular to its length, it is contemplated that other means such as scoring may be used to encourage the paper to fold at a particular location. For example, rather than parallel perforations extending across the carrier sheet, parallel scores or creases formed in the paper would serve to encourage the paper to fold along such scores or creases.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for folding pre-scored or preperforated continuous elongate carrier paper having a plurality of parallel scores or perforations extending across the carrier paper perpendicular to the length thereof comprising:

(a) creating relative movement between a single endless array of spaced-apart members and paper feed means for moving said carrier paper in a direction substantially perpendicular to said scores or perforations, so as to successively present said spaced-apart members to said paper feed means; and (b) feeding said paper into said array so that said spaced-apart members strike said paper proximately on selected ones of said scores or perforations, causing said paper to fold at said selected scores or perforations.

2. The method of claim 1 further including the step of causing said paper to fold on intermediate ones of said scores or perforations, said intermediate scores or perforations being located between adjacent ones of said selected scores or perforations.

3. The method of claim 2 including causing said paper to fold on said intermediate scores or perforations in a direction opposite to the folds on said selected scores or perforations.

4. The method of claim 3 wherein said selected scores or perforations and said intermediate scores or perforations define a plurality of faces therebetween, further including the step of compressing said folded carrier paper so that adjacent ones of said faces are urged into close contact with each other.

5. The method of claim 1 including feeding said paper into said array of spaced-apart members so as to cause said paper to enter between adjacent ones of said spaced-apart members.

6. The method of claim 1 wherein said paper coming out of said paper feed means defines a plane, and each of said spaced-apart members defines a line, said array of spaced-apart members moving with respect to said paper feed means so that said lines defining said members are successively substantially contained within said plane.

7. The method of claim 1 including indexing said selected perforations to said members so that said members strike said paper proximately on said selected scores or perforations.

8. The method of claim 1 including synchronizing the paper feed speed of said paper feed means with the speed of the relative movement between said array and said paper feed means so that said members strike said paper proximately on said selected scores or perforations.

9. An apparatus for positioning documents on carrier paper of the type having a plurality of faces separated by fold lines, said apparatus comprising:

(a) document feed means for successively delivering said documents to a predetermined location;

(b) carrier feed means for continuously moving said carrier paper past said predetermined location; and (c) positioning means for arranging said carrier paper in a wave-form configuration with troughs formed between adjacent faces as said carrier paper passes said predetermined location, said positioning means including an array of spaced apart members, said document feed means and said carrier feed means positioned with respect to each other so that said document feed means delivers said documents into said troughs.

10. The apparatus of claim 1 wherein adjacent ones of said spaced-apart members define channel means therebetween for receiving said troughs.

11. The apparatus of claim 1 wherein said positioning means includes guard means for urging said carrier paper into contact with said spaced-apart members and maintaining said open wave-form configuration as said carrier paper passes said predetermined location.

12. The apparatus of claim 1 wherein said carrier feed means includes endless belt means and said positioning means includes an array of spaced-apart members supportably arranged on said belt means.

13. An apparatus for forming folds along selected scores or perforations of pre-scored or pre-perforated continuous elongate carrier paper having a plurality of parallel scores or perforations extending across the carrier paper perpendicular to the length thereof comprising:

(a) a single endless array of spaced-apart members defining channels therebetween;

(b) paper feeding means for feeding said paper toward said array in a direction perpendicular to said scores or perforations, said paper feeding means defining a paper plane;

(c) means for moving said array past said paper feeding means so that said members of said array successively pass through said plane striking said paper proximately on said selected scores or perforations and causing said paper to fold thereon; and (d) said paper feeding means and said array positioned with respect to each other said members of said array successively substantially contained within said plane and said paper is fed into said channels in a direction substantially parallel to those of said members adjacent to said channel.

14. The apparatus of claim 13 wherein said array and said paper feeding means are arranged so that when said member strikes said paper said members are moving in a direction substantially perpendicular to said paper plane.

15. The apparatus of claim 13 including indexing means for causing said members to strike said paper proximately on said selected scores or perforations, said indexing means cooperating between said means for moving said array and said paper feeding means.

* * * * *

UNITED STATES PATENT AND TRADEMARK OFFICE

CERTIFICATE OF CORRECTION

PATENT NO. : 4,586,703

DATED : May 6, 1986

INVENTOR(S) : Jan A. McAnelly

It is certified that error appears in the above-identified patent and that said Letters Patent is hereby corrected as shown below:

| | | |
|---|---|---|
| Col. 3, | Line 6 | After "Referring" insert --to-- |
| Col. 4, | Line 3 | Change "preceeding" to -preceding-- |
| Col. 4, | Line 4 | After "as" delete --a-- |
| Col. 4, | Line 12 | Change "preceeding" to --preceding-- |
| Col. 4, | Line 25 | Change "preceeding" to --preceding-- |
| Col. 6, | Line 52 | Change "esssential" to --essential-- |
| Col. 7, | Line 53 | Change "preceeding" to --preceding-- |
| Col. 10, | Line 10 | Change "1" to --9-- |
| Col. 10, | Line 13 | Change "1" to --9-- |
| Col. 10, | Line 18 | Change "1" to --9-- |

UNITED STATES PATENT AND TRADEMARK OFFICE

CERTIFICATE OF CORRECTION

PATENT NO. : 4,586,703

DATED : May 6, 1986

INVENTOR(S) : Jan A. McAnelly

It is certified that error appears in the above-identified patent and that said Letters Patent is hereby corrected as shown below:

Col. 10, Line 40 After "other" insert --so that--

Col. 10, Line 41 After "array" insert --are--.

Signed and Sealed this

Twenty-seventh Day of January, 1987

*Attest:*

DONALD J. QUIGG

*Attesting Officer* *Commissioner of Patents and Trademarks*